US006280147B1

(12) United States Patent
Kilayko et al.

(10) Patent No.: US 6,280,147 B1
(45) Date of Patent: Aug. 28, 2001

(54) APPARATUS FOR ADJUSTING THE STROKE LENGTH OF A PUMP ELEMENT

(75) Inventors: Enrique L. Kilayko, Spruce Head, ME (US); Liam Ryan, Limerick (IE)

(73) Assignee: Liquid Metronics Incorporated, Acton, MA (US)

( * ) Notice: Subject to any disclaimer, the term of this patent is extended or adjusted under 35 U.S.C. 154(b) by 0 days.

(21) Appl. No.: 09/550,351

(22) Filed: Apr. 14, 2000

Related U.S. Application Data

(63) Continuation-in-part of application No. 09/170,438, filed on Oct. 13, 1998.

(51) Int. Cl.[7] ..... F04B 49/00; F04B 49/06

(52) U.S. Cl. ..... 417/15; 417/44.1

(58) Field of Search ..... 417/15, 44.1, 44.2, 417/45, 212, 413.1

(56) References Cited

U.S. PATENT DOCUMENTS

| | | |
|---|---|---|
| 3,602,246 | 8/1971 | Hettinger et al. . |
| 3,715,174 | 2/1973 | Davis et al. . |
| 3,723,840 | 3/1973 | Opal et al. . |
| 3,855,515 | 12/1974 | Hutchins, Jr. . |
| 3,984,315 | 10/1976 | Ernst et al. . |
| 4,147,824 | 4/1979 | Dettmann et al. . |
| 4,195,662 | 4/1980 | Gottel . |
| 4,285,497 | 8/1981 | Guttel . |
| 4,291,358 | 9/1981 | Dettmann et al. . |
| 4,473,338 | 9/1984 | Garmong . |
| 4,523,902 | 6/1985 | Wally . |
| 4,534,539 | 8/1985 | Dettmann . |
| 4,578,626 | 3/1986 | Richter . |
| 4,661,751 | 4/1987 | Werner . |
| 4,718,824 | 1/1988 | Cholet et al. . |
| 4,811,624 | 3/1989 | Fritsch . |
| 4,839,571 | 6/1989 | Farnham et al. . |
| 4,841,404 | 6/1989 | Marshall et al. . |
| 4,966,528 | 10/1990 | Henkel et al. . |
| 4,994,984 | 2/1991 | Massimo . |
| 5,013,990 | 5/1991 | Weber . |
| 5,015,153 | 5/1991 | Uesugi et al. . |
| 5,040,567 | 8/1991 | Nestler et al. . |
| 5,054,522 | 10/1991 | Kowanz et al. . |
| 5,056,036 | 10/1991 | Van Bork . |
| 5,096,643 | 3/1992 | Kowanz et al. . |

(List continued on next page.)

FOREIGN PATENT DOCUMENTS

| | | |
|---|---|---|
| 42 30 662 A1 | 9/1991 | (DE) . |
| 0 294 858 A2 | 12/1988 | (EP) . |
| 0 483 447 A2 | 5/1992 | (EP) . |
| 1 567 041 | 5/1980 | (GB) . |
| 2108212 A | 5/1983 | (GB) . |

OTHER PUBLICATIONS

Product Brochure "Meeting Pumps", LMI Milton Roy, Jun. 1998.

Product Brochure "Meeting Pumps and Accessories" created in Oct. 1992 for Liquid Metronics Division of Milton Roy.

International Search Report, PCT/US99/23136, May. 24, 2000.

*Primary Examiner*—Teresa Walberg
*Assistant Examiner*—Vinod D. Patel

(57) ABSTRACT

A metering pump includes an apparatus for adjusting the stroke length of a pump element. The apparatus comprises a lever having a cam which is contacted by the pump element.

17 Claims, 14 Drawing Sheets

U.S. PATENT DOCUMENTS

| | | |
|---|---|---|
| 5,120,199 | 6/1992 | Youngs et al. . |
| 5,141,402 | 8/1992 | Bloomquist et al. . |
| 5,204,595 | 4/1993 | Opal et al. . |
| 5,249,932 | 10/1993 | Van Bork . |
| 5,260,175 | 11/1993 | Kowanz et al. . |
| 5,269,659 | 12/1993 | Hampton et al. . |
| 5,372,482 | 12/1994 | London et al. . |
| 5,543,108 | 8/1996 | Bacher et al. . |
| 5,545,012 | 8/1996 | Anastos et al. . |
| 5,549,456 | 8/1996 | Burrill et al. . |
| 5,551,664 | 9/1996 | Boke . |
| 5,641,270 | 6/1997 | Sgourakes et al. . |
| 5,650,709 | 7/1997 | Rotunda et al. . |
| 5,653,422 | 8/1997 | Pieloth et al. . |
| 5,711,346 | 1/1998 | Pieloth et al. . |
| 5,718,567 | 2/1998 | Rapp et al. . |
| 5,746,079 | 5/1998 | Hettinger et al. . |
| 5,762,097 | 6/1998 | Hettinger et al. . |
| 5,779,218 | 7/1998 | Kowanz . |

APPARATUS FOR ADJUSTING THE STROKE LENGTH OF A PUMP ELEMENT

REFERENCE TO RELATED APPLICATION

This is a continuation-in-part of U.S. patent application Ser. No. 09/170,438, filed Oct. 13, 1998, entitled "Pump Control and Method of Operating Same".

TECHNICAL FIELD

The present invention relates generally to pumps, and more particularly to an apparatus for adjusting the stroke length of a pump element.

BACKGROUND OF THE INVENTION

Often, it is necessary in an industrial or other process to inject a measured quantity of a flowable material into a further stream of material or a vessel. Metering pumps have been developed for this purpose and may be either electrically or hydraulically actuated.

Conventionally, an electromagnetic metering pump utilizes a linear solenoid which is provided electrical pulses to move a diaphragm mechanically linked to an armature of the solenoid. As the solenoid is energized and deenergized, the armature and the diaphragm are reciprocated in suction and discharge strokes over a range of positions. Referring to FIG. 1, during each suction stroke, liquid is drawn upwardly through a first fitting 51 past a first check valve 53 and enters a diaphragm recess 55. A second check valve 57 is closed during the suction stroke. During each discharge stroke, the first check valve 53 is closed and the second check valve 57 is opened, thereby allowing the liquid to travel upwardly past the second check valve 57 and a fitting 59 and outwardly of the pump 21.

A stroke length adjustment member sets the stroke length of the armature 31 (i.e., the distance the armature travels during each suction and discharge stroke). As shown in FIG. 1, the stroke length adjustment member is conventionally a combination of a screw 40 and a knob 42. The armature 31 rests against an end of the screw 40 at the end of each suction stroke. The position of the end of the screw 40, and thus the stroke length, can be adjusted by manually rotating the knob 42 in either a first or second direction.

When the pump is not operating, however, the screw 40 can be rotated to shorten the stroke length only when the armature 31 is spaced from the end of the screw 40, i.e., when the armature is not at the end of a suction stroke. This is because the screw 40 is not capable of providing the required mechanical force to change the stroke length when the armature 31 is in contact with the end of the screw 40.

SUMMARY OF THE INVENTION

In accordance with the present invention, a metering pump includes an apparatus for manually adjusting the stroke length of a pump element.

More particularly, in accordance with one aspect of the present invention, a pump includes a pump element having a stroke length movable within a range of positions, a circuit for modulating electrical power to a power unit in dependence upon the position of the pump element and an apparatus for adjusting the stroke length of the pump element including a lever wherein the apparatus contacts the pump element at a position within the range of positions to determine the stroke length of the pump element.

Preferably, the pump element includes an armature and the pump further includes a sensor for detecting the position of the pump element. Also preferably, the pump further includes a processor responsive to the sensor for applying electrical power to the pump in dependence upon the position of the pump element.

In addition, the lever preferably includes a first portion which is manually operable and a second portion. The apparatus may also include a cam having a stop surface that is coupled to the second portion of the lever, wherein the stop surface contacts the pump element to determine the stroke length of the pump element. The cam may be coupled to the second portion of the lever by a cap nut and the lever may be coupled to a bracket also by a cap nut. The first portion of the lever may include a locking surface. Furthermore, movement of the lever in a first direction decreases the stroke length of the pump element and movement of the lever in a second direction increases the stroke length of the pump element.

In the preferred embodiment, the pump comprises an electromagnetic metering pump.

In accordance with a further aspect of the present invention, a metering pump having a power unit and an armature movable over a stroke length comprises a sensor for detecting armature position and a driver circuit coupled to the power unit and delivering electrical power to the power unit. A programmed processor is responsive to the sensor for controlling the driver circuit such that electrical power is delivered to the power unit in dependence upon the position of the armature. An apparatus for adjusting the stroke length of the armature includes a lever having a first portion which is manually operable, a second portion and a cam coupled to the second portion. The cam includes a stop surface having a position which is variable as a function of the position of the first portion of the lever wherein the position of the stop surface determines the stroke length.

DESCRIPTION OF THE PREFERRED EMBODIMENTS

Figure 12:
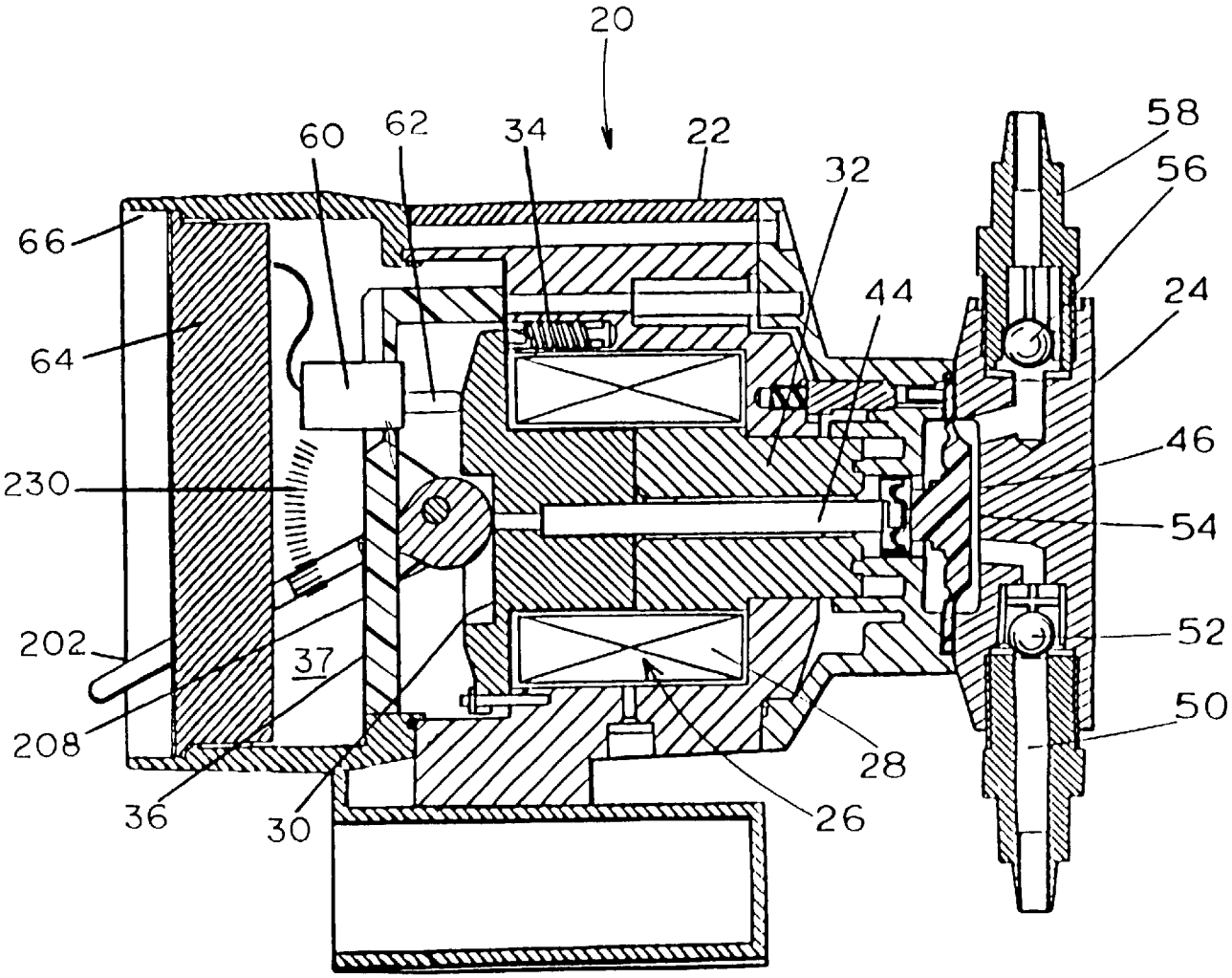
FIG. 12 is a partial sectional view taken generally along the lines 12—12 of FIG. 11 wherein the armature of the pump is at the end of a discharge stroke and the lever of the stroke adjustment apparatus is set to a zero stroke length.
Figure 13:
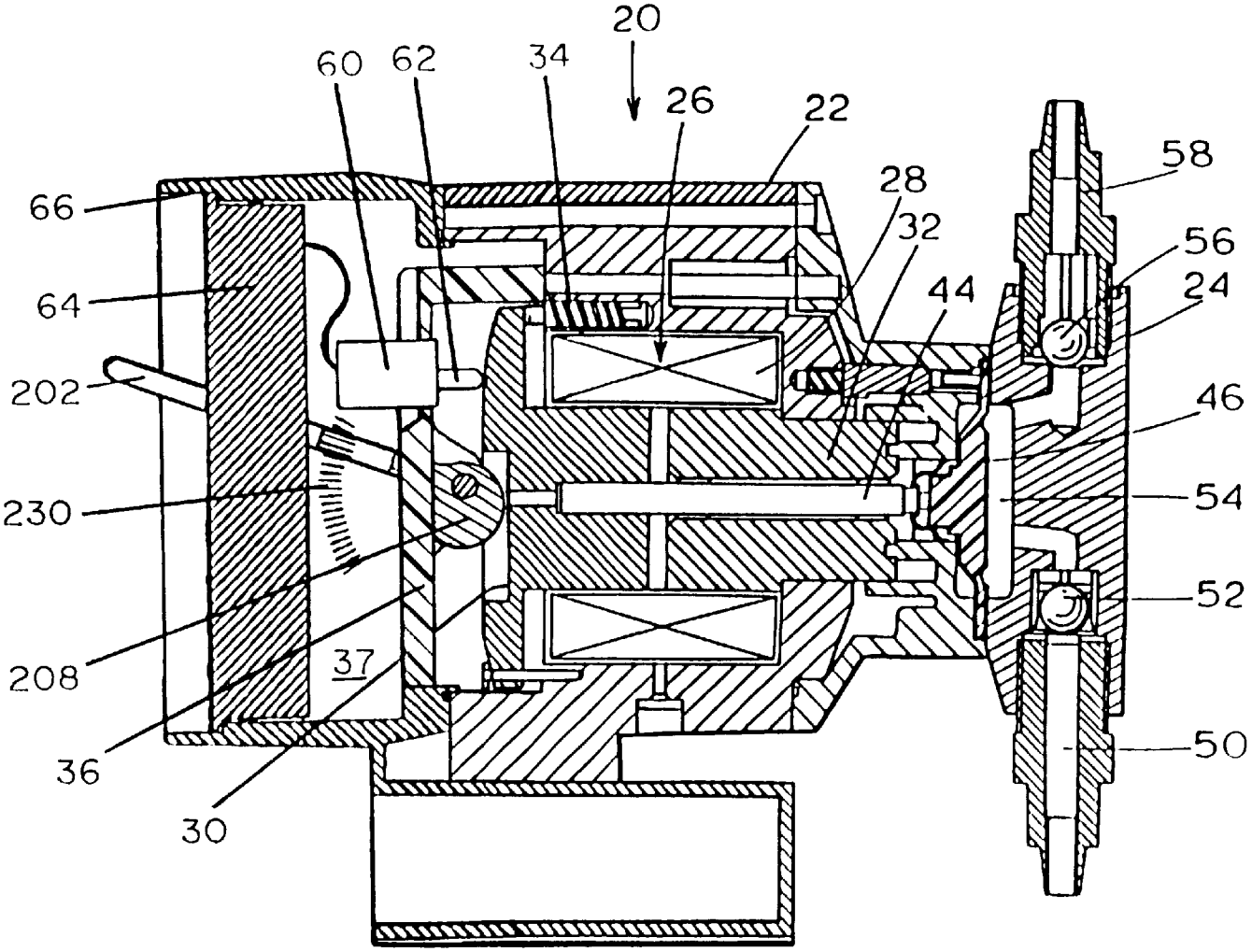
FIG. 13 is a view similar to FIG. 12 wherein the armature of the pump is at the end of a suction stroke and the lever of the stroke adjustment apparatus is set to a substantially maximum stroke length.

Referring now to FIGS. 12 and 13, there is illustrated an electromagnetic metering pump 20 which may incorporate the present invention. The metering pump 20 includes a main body 22 joined to a liquid end 24. The main body 22 houses an electromagnetic power unit (EPU) 26 that comprises a coil 28 and a movable armature 30. The EPU 26 further includes a pole piece 32 which, together with the coil 28 and the armature 30 form a magnetic circuit. The armature 30 is biased to the left by at least one, and preferably a plurality of circumferentially spaced return springs 34 such that, when no excitation is provided to the coil 30, the armature 30 rests against a cam 208. It should be noted that the armature is preferably balanced in the horizontal position; i.e., the return springs disposed between the 10 o'clock and 2 o'clock positions (when viewed from the side relative to the position shown in FIG. 12) exert lesser biasing forces than the return springs disposed between the 4 o'clock and 8 o'clock positions. This arrangement results in less wear of the bearings supporting the armature and less slip-stick so that less current is required to move the armature within the desired operational constraints.

A shaft 44 is coupled to and moves with the armature 30. The shaft 44 is in turn coupled to a pump diaphragm 46 which is sealingly engaged between the main body 22 and the liquid end 24. As the coil 28 is energized and deenergized, the armature 30, the shaft 44 and the diaphragm 46 are reciprocated. During such reciprocation, liquid is drawn upwardly through a first fitting 50 past a first check valve 52 and enters a diaphragm recess 54. The liquid then continues to travel upwardly past a further check valve 56 and a fitting 58 and outwardly of the pump 20.

A position sensor 60 is provided having a shaft 62 in contact with the armature 30 and develops a signal representative of the position of the armature 30. If desired, the position sensor 60 may be replaced by one or more transducers which develop signals representing the differential between the pressure encountered by the diaphragm 46 and the fluid pressure at the point of liquid injection from the pump. In this case, the power supplied to the coil 28 is controlled so that this pressure difference is kept low but will still finish the discharge stroke within a desired length of time.

Figure 4:
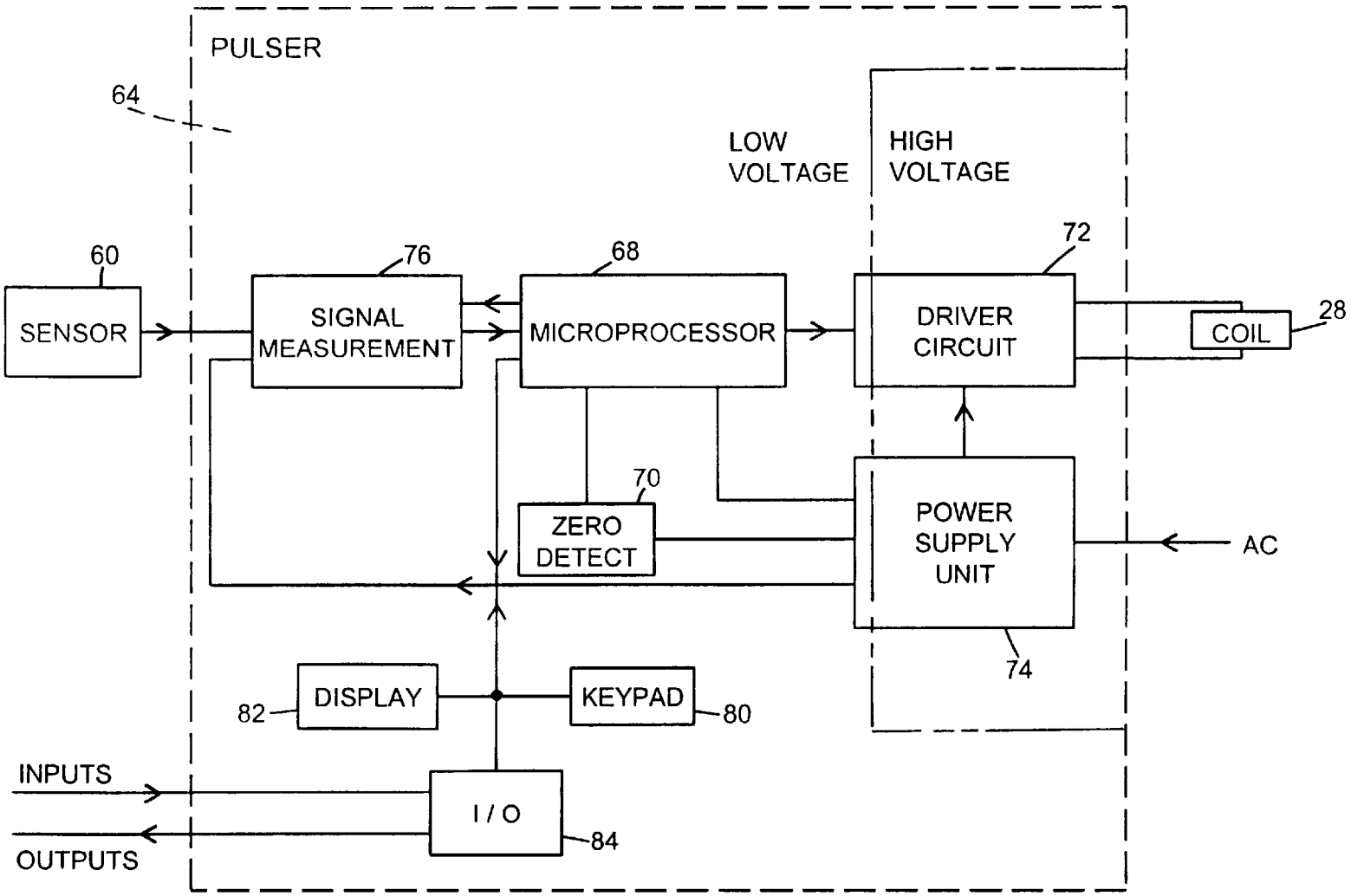
FIG. 4 is a block diagram of a circuit for controlling the metering pump of FIGS. 12 and 13.
Figure 10:
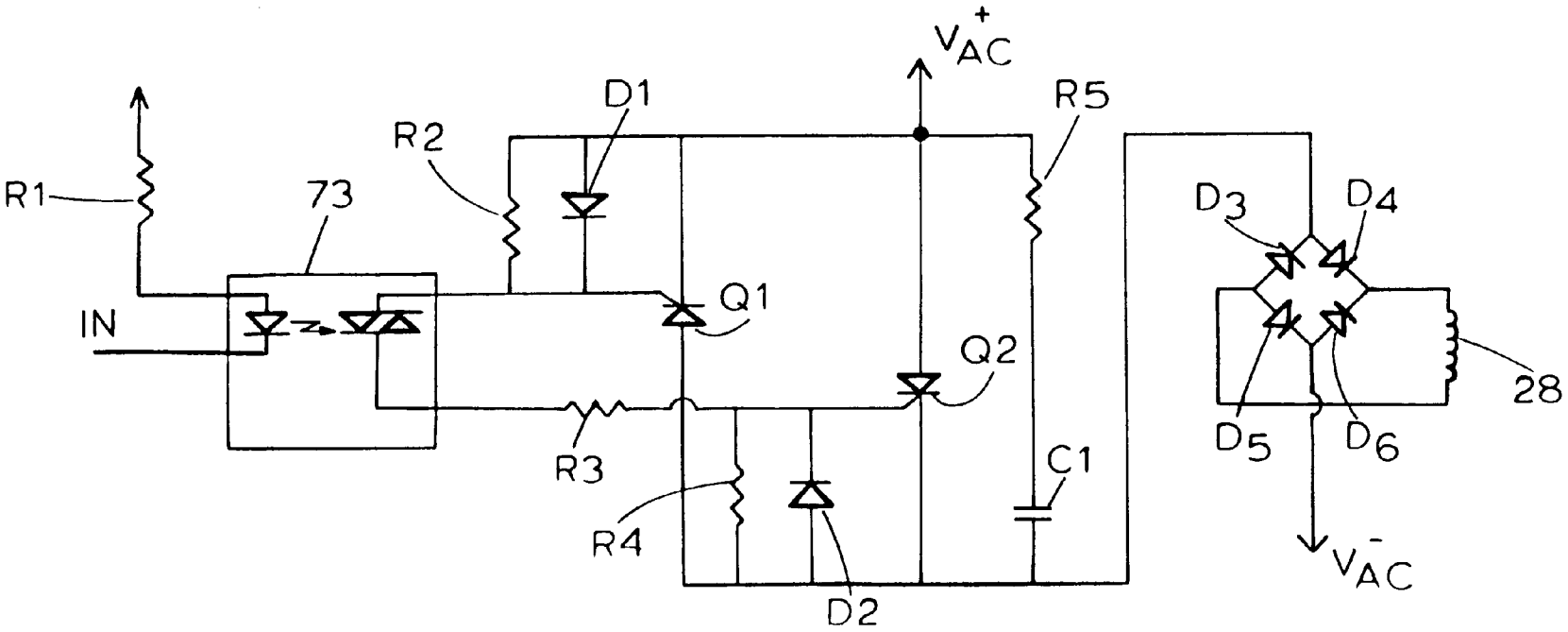
FIG. 10 is a schematic diagram of the circuit of FIG. 4.

A pulser circuit 64 is provided in a recess 66. As seen in FIG. 4, the pulser comprises a number of circuit components including a microprocessor 68 which is responsive to a zero detection circuit 70 and which develops signals for controlling a driver circuit 72. Referring also to FIG. 10, the microprocessor 68 develops control signals which are supplied via an input IN of an opto-isolator 73 to cross-connected switching elements, such as SCR's Q1 and Q2 or other devices such as IGBT's, power MOSFET's or the like. Resistors R1–R5, diodes D1 and D2 and capacitor C1 provide proper biasing and filtering as needed. The SCR's Q1 and Q2 provide phase controlled power which is rectified by the full wave rectifier comprising diodes D3–D6 and supplied to the coil 28. If desired, the microprocessor 68 may instead control the driver circuit 72 to supply pulse width modulated power or true variable DC power to the coil 28.

Figure 2:
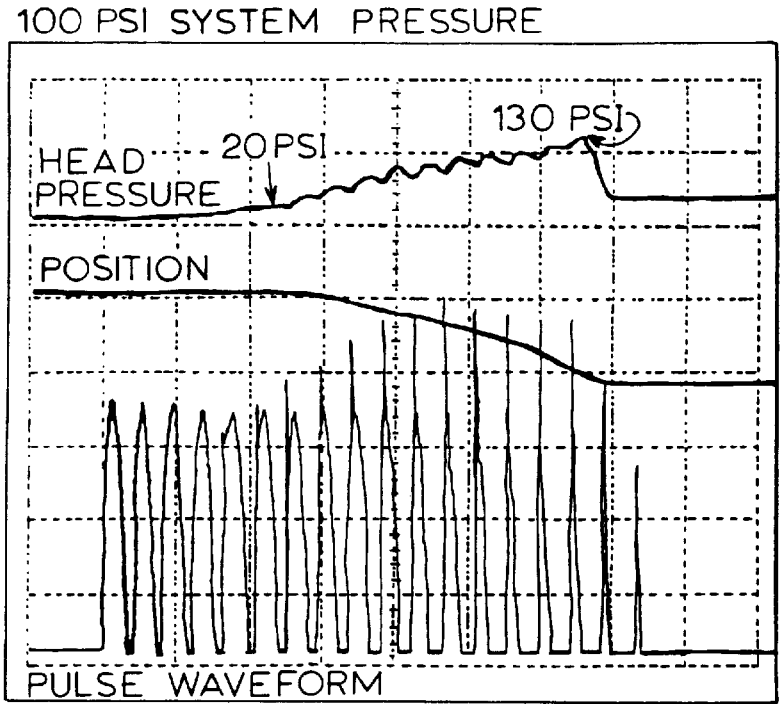
FIGS. 2 and 3 are waveform diagrams illustrating head pressure, armature position and applied pulse waveform at 100 psi and 40 psi system pressure, respectively, for the pump illustrated in FIG. 12.
Figure 3:
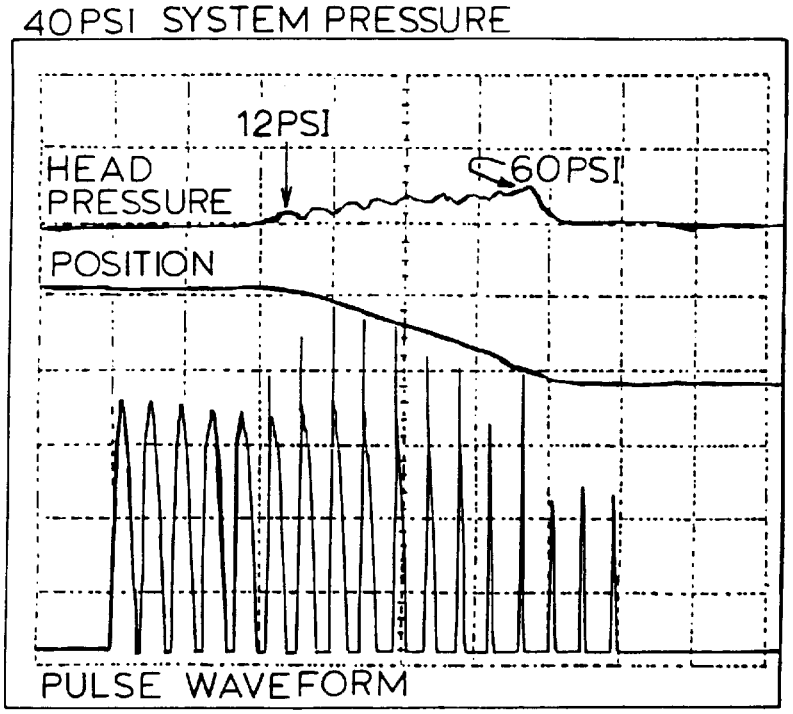
Figure 8:
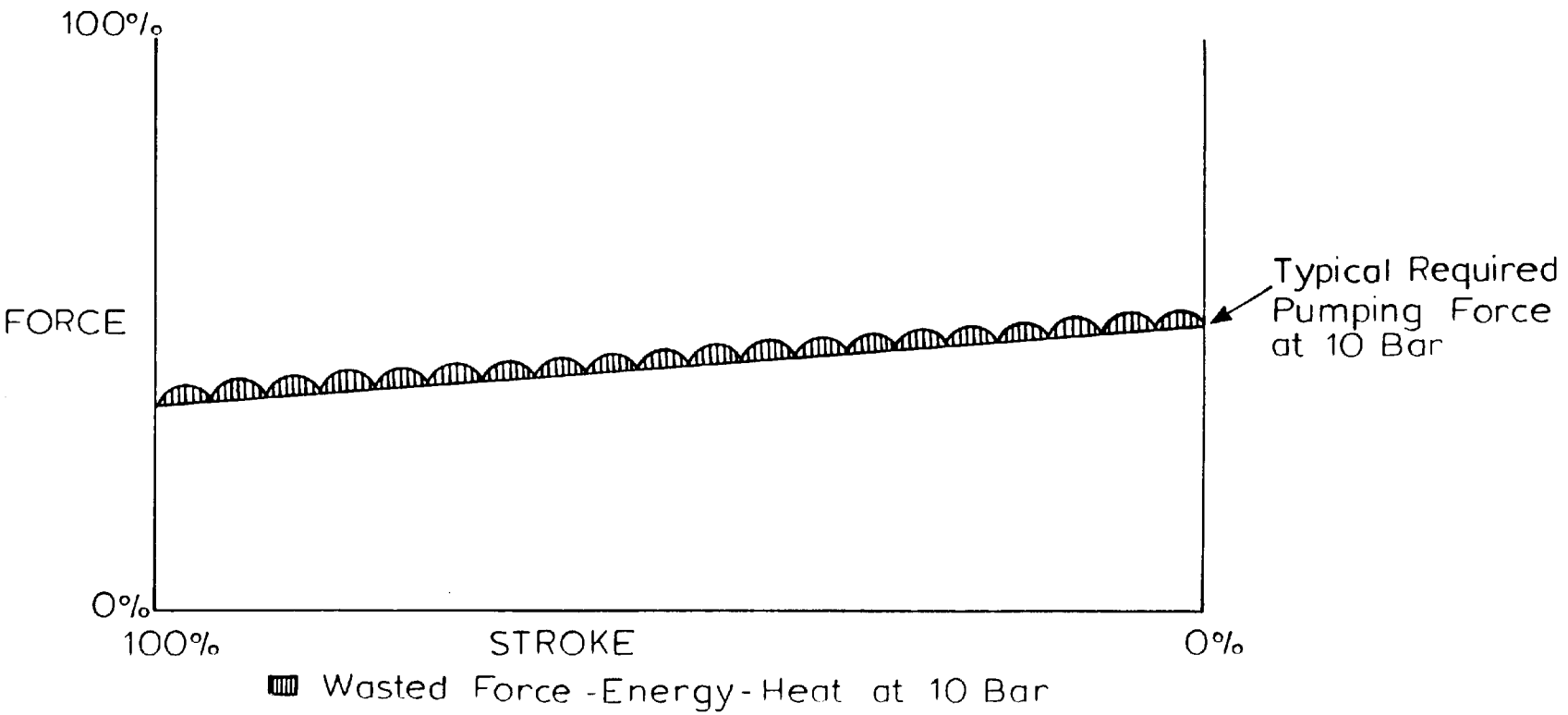
FIGS. 8 and 9 are idealized graphs illustrating armature force as a function of armature position for the pump of FIGS. 12 and 13.
Figure 9:
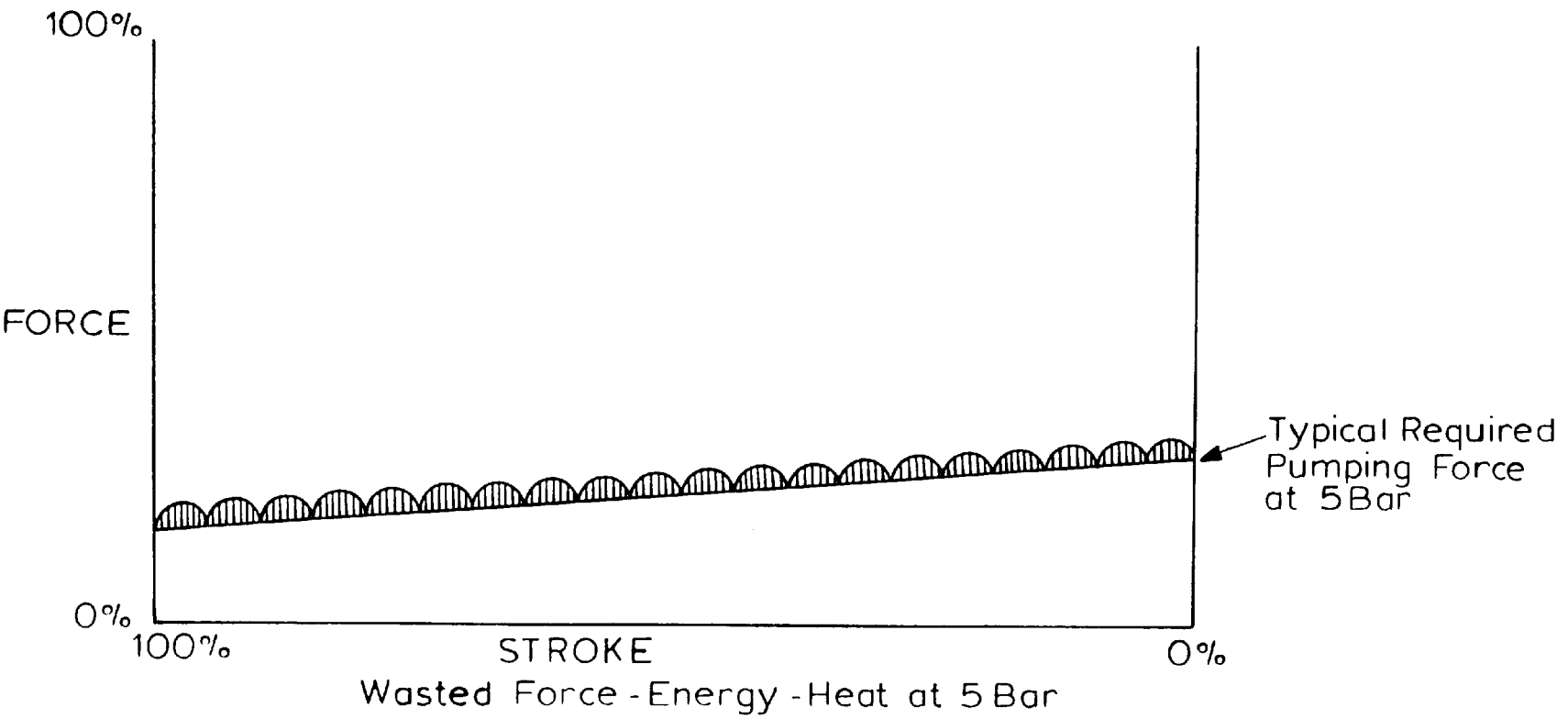

FIGS. 2 and 3 illustrate the operation of the metering pump shown in FIGS. 12 and 13 at 100 psi system pressure and 40 psi system pressure, respectively (the system pressure is the liquid pressure at the point of injection of a liquid delivered by the pump 20 into a conduit containing a further pressurized liquid). As illustrated by each of the waveform diagrams of FIGS. 2 and 3, half-wave rectified pulses are appropriately phase controlled (i.e., either a full half-wave cycle or a controllably adjustable portion of a half-wave cycle) and are applied to the coil 28 as a function of position and speed of the armature 30 (as detected by the sensor 60) so that only enough power is supplied to the coil 28 to move the armature 30 the entire stroke length without wasting significant amounts of force and energy and generating significant amounts of heat. In the waveform diagrams of FIG. 2, the head pressure (i.e, the pressure to which the diaphragm 46 is exposed) varies between 20 psi and 130 psi as the armature moves over the stroke length. In the case of the waveform diagrams of FIG. 3, the head pressure varies between 12 psi and 60 psi as the armature 30 moves over the stroke length. In both cases, half-wave rectified sinusoidal pulses are initially applied to the coil 28 wherein the pulses are phase controlled to obtain pulse widths that result in a condition just short of or just at saturation of the EPU 26. Thus, the armature 30 is accelerated as quickly as possible without significant heat generation and dissipation. Thereafter, narrower pulses are applied as the armature 30 moves toward its travel limit. FIGS. 8 and 9 illustrate the tracking of developed EPU force with system pressure as a function of armature position for the pump of FIGS. 12 and 13. It can be seen that relatively little power is wasted, and hence, noise is reduced (because the armature does not slam into the pole piece 32 at the end of the stroke) as are generated heat levels.

Referring again to FIG. 4, the EPU driver receives the AC power from a power supply unit 74, which also supplies power to the microprocessor 68 and a signal measurement interface circuit 76 that receives an output signal developed by the position sensor 60. The zero detect circuit 70 detects zero crossings in the AC waveforms and provides an interrupt signal to the microprocessor 68 for purposes hereinafter described.

Figure 5:
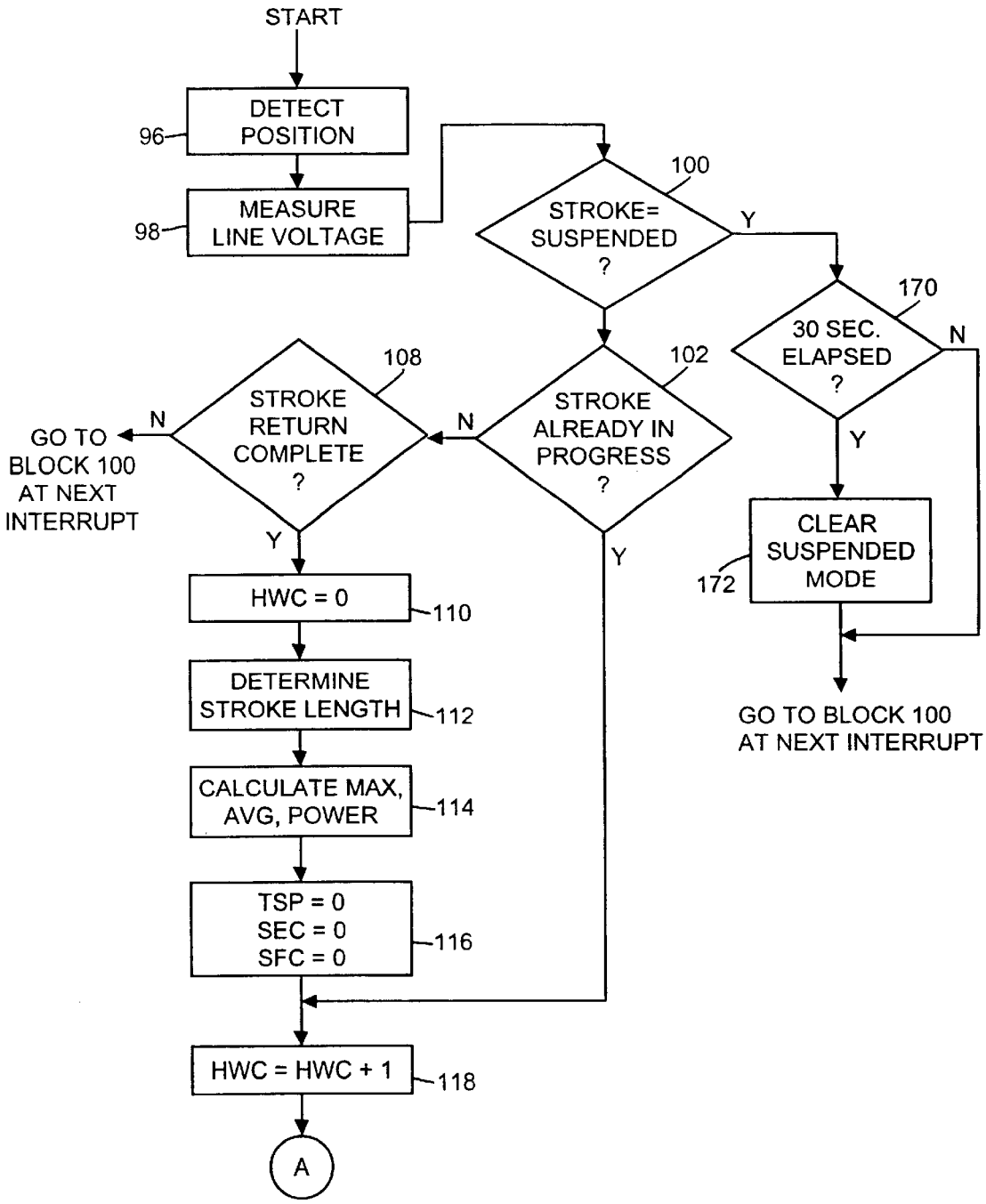
FIGS. 5, 6, and 7, when joined along the similarly lettered lines, together comprise a flowchart of programming executed by the microprocessor of FIG. 4.
Figure 6:
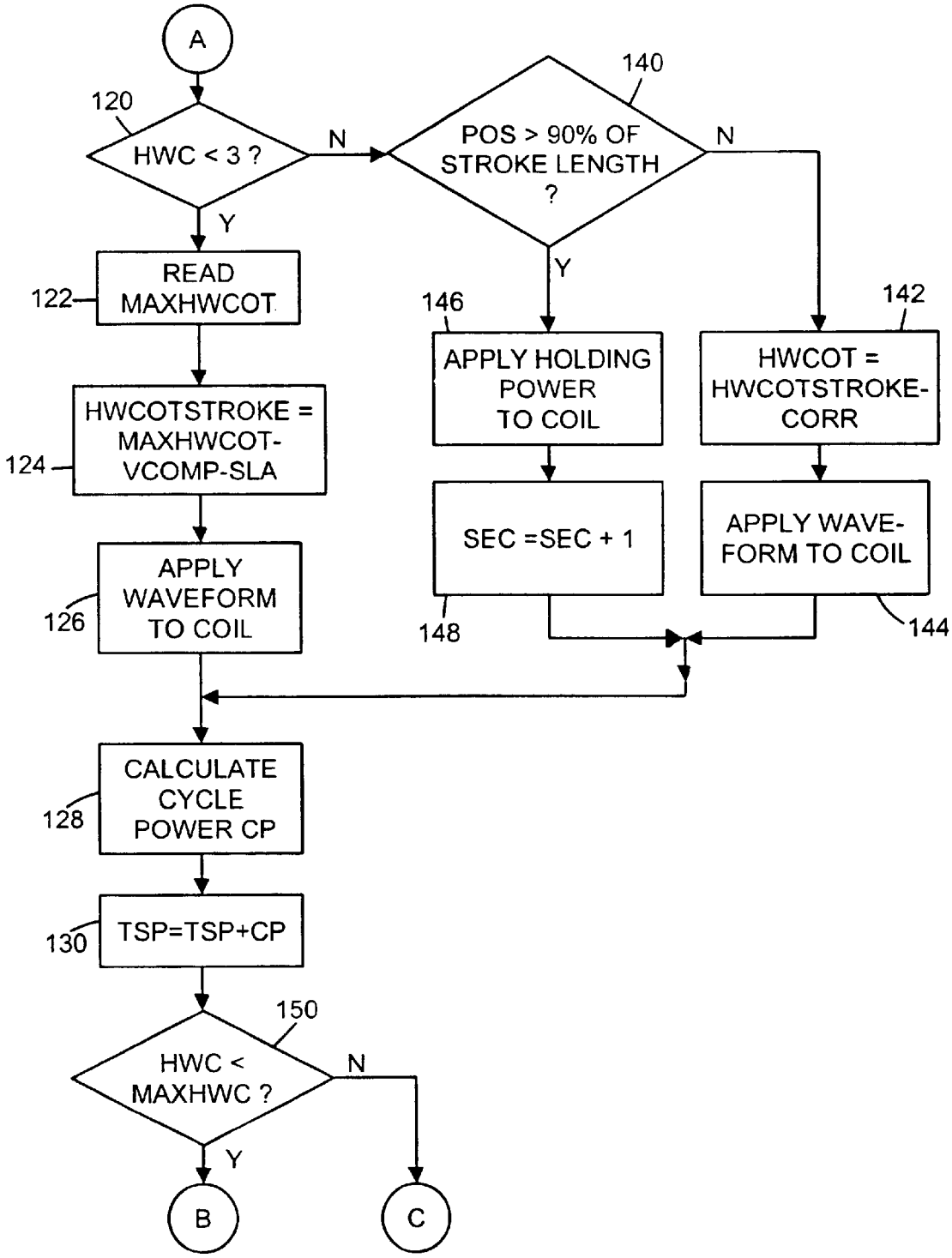
Figure 7:
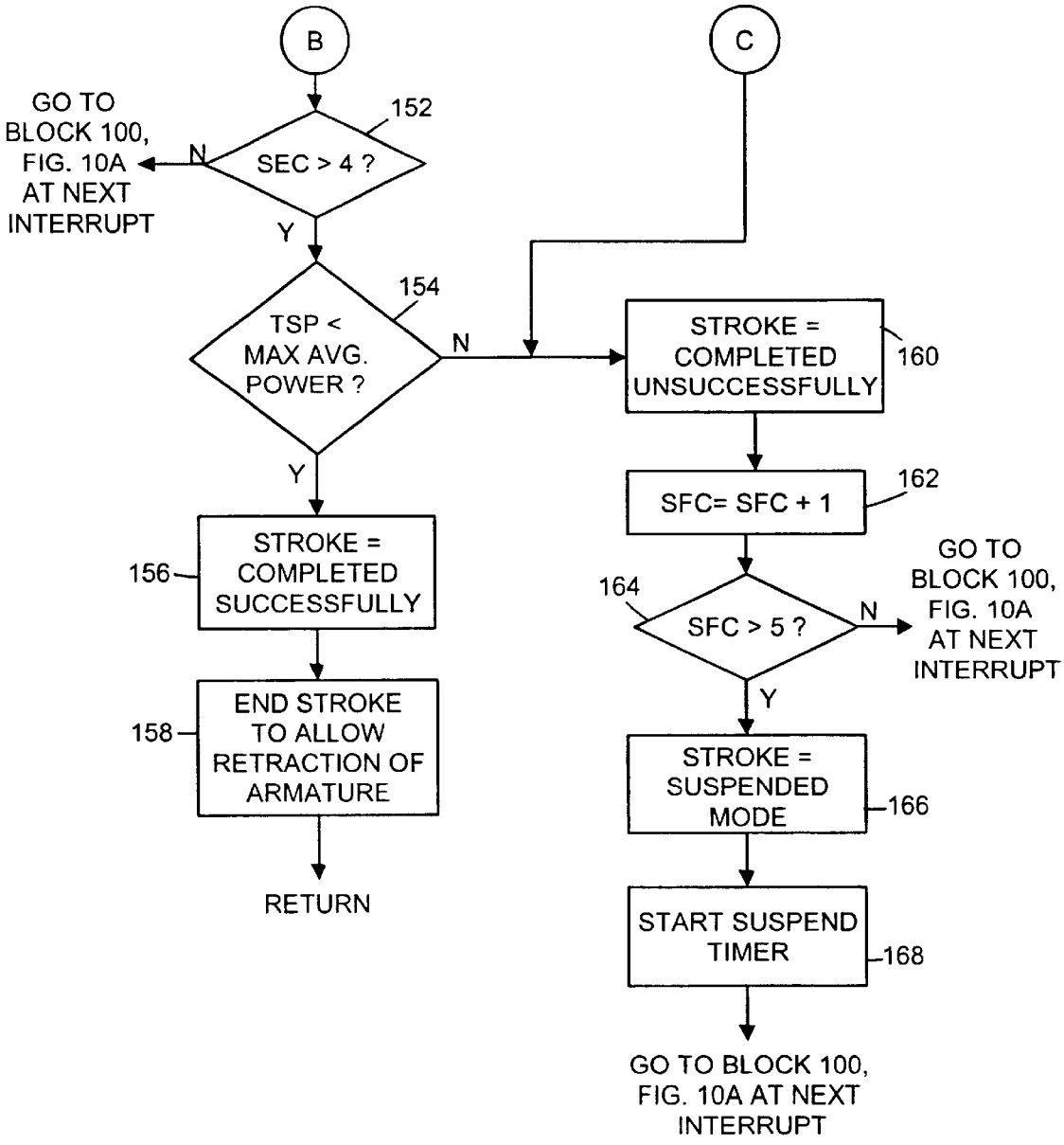

In addition to the foregoing, the microprocessor may be coupled to a keypad 80 and a display 82, as well as other input/output (I/O) circuits 84 as desired or required. The microprocessor 68 (not shown) is suitably programmed to execute a control routine, a portion of which is illustrated in FIGS. 5, 6 and 7. The software of FIGS. 5, 6, and 7 is operable in response to interrupts provided to the microprocessor 68 by the power supply unit 74 to synchronize the operation of the microprocessor 68 to the pulses delivered to the EPU driver 72. The balance of the software executed by the microprocessor 68 (not shown) determines when the software illustrated in FIGS. 5, 6 and 7 should be executed. This decision may be made in response to an initiation signal developed by a user or by apparatus which is responsive to some operational parameter of a process or in response to any other signal.

Referring first to FIG. 5, once the microprocessor 68 determines that the software illustrated by FIGS. 5, 6 and 7 is to be executed, a block 96 checks the output of the signal measurement circuit 76 to detect the position of the armature 30. A block 98 then operates the signal measurement interface circuit 76 to sense the magnitude of the AC voltage supplied by the power supply unit 74. Thereafter, a block 100 checks to determine whether a flag internal to the microprocessor 68 has been set indicating that pumping has been suspended. If this is not the case, a block 102 checks to determine whether a stroke of the armature 30 is already in progress. If this is not true, a block 108 checks to determine whether the armature 30 has returned to its rest position under the influence of the return springs 34. This is determined by checking the output of the position sensor 60 and the signal measurement circuit 76. If this is not the case, control returns to the block 100 when the next interrupt is received. Otherwise, control passes to a block 110, which initializes a variable HWC (denoting half wave cycle number) to a value of zero.

Following the block 110, a block 112 determines the length of the stroke to be effected as set by a stroke length adjustment apparatus described hereinafter. Based upon stroke length and stroke rate, a block 114 calculates a maximum average power level APMAX which is not to be exceeded during the stroke as follows:

$$APMAX = \frac{CPMAX * SPMMAX * SLAMAX}{SPM * SLA}$$

where CPMAX is a stored empirically-determined value representing the maximum continuous power allowed at maximum stroke length (SLAMAX), maximum stroke rate (SPMMAX) and maximum pressure. (SLAMAX and SPMMAX are stored as well.) SPM is the actual stroke rate which may be determined and input by a user or which may be a parameter set by an external device. SLA is the stroke length as determined by the block 112.

The value of APMAX represents the maximum power to be applied to the coil 28 beyond which no further useful work will result (in fact, a deterioration in performance and heating will occur). Following the block 114, a block 116 initializes variables TSP (denoting total stroke power), SEC (a stroke end counter which is incremented at the end of the stroke) and SFC (a stroke fail counter which is incremented at the end of a failed stroke) to zero.

Following the block 116, and following the block 102 if it has been determined that a stroke is already in progress, a block 118 increments the value of HWC by one and control passes to a block 120, FIG. 6. The block 120 checks to determine whether the value of HWC is less than or equal to three. If this is found to be true, control passes to a block 122 which reads a value MAXHWCOT stored in the microprocessor 68 and representing the maximum half wave cycle on time (i.e., the maximum half wave pulse width or duration). This value is dependent upon the frequency of the AC power supplied to the power supply unit 74.

A block 124 then establishes the value of a variable HWCOTSTROKE (denoting half wave cycle on time for this stroke) at a value equal to MAXHWCOT less a voltage compensation term VCOMP and less a stroke length adjustment term SLA. It should be noted that either or both of VCOMP and SLA may be calculated or determined in accordance with empirically-derived data and/or may be dependent upon a parameter. For example, each of a number of positive and/or negative empirically-determined values of VCOMP may be stored in a look-up table at an address dependent upon the value of the AC line voltage magnitude as sensed by the block 98 of FIG. 5. The term SLA may be determined in accordance with the stroke length as set by the lever 202. Specifically, each of a number of empirically-determined values of SLA may be stored in a look-up table at an address dependent upon the stroke length determined by the block 112. Following the block 124, a block 126 operates the EPU driver circuit 72 so that a half-wave rectified pulse of duration determined by the current value of HWCOTSTROKE is applied to the coil 28.

Thereafter, a block 128 calculates the total power applied to the coil 28 by the block 126 and a block 130 accumulates a value TSP representing the total power applied to the coil 28 over the entire stroke. The value TSP is equal to the accumulated power of the previous pulses applied to the coil 28 during the current stroke as well as the power applied by the block 126 in the current pass through the programming.

If the block 120 determines that the value of HWC is greater than 3, a block 140 checks to determine whether the position of the armature 30 is greater than 90% of the total stroke length (in other words, the block 140 checks to determine whether the armature 30 is within 10% of the end of travel thereof). If this is not true, the value HWCOT is calculated by a block 142 as follows:

HWCOT=HWCOTSTROKE−CORR

Each of a number of values for the term CORR in the above equation may be stored in a look-up table at an address dependent upon the distance traveled by the armature 30 since the last cycle, the current position of the armature 30 as well as the current value of HWC (i.e., the number of half-waves that have been applied to the coil 28 during the current stroke). The function of the block 142 is to reduce the power applied during each cycle as the stroke progresses. Thereafter, a block 144 operates the driver 72 to apply a half-wave rectified pulse, appropriately phase controlled in accordance with the value of HWCOT, to the coil 28. Following the block 144, control passes to the block 128.

If the block 140 determines that the position of the armature 30 is within 10% of the stroke length, a block 146 controls the EPU driver 72 to apply a voltage to the coil 28 sufficient to hold the coil at the end of travel. Preferably, this value is selected to provide just enough holding force to keep armature 30 at the end of travel limit but is not-so high as to result in a significant amount of wasted power. Following the block 146, a block 148 increments the stroke end counter SEC by one and control passes to the block 128.

Once the current cycle power and the total stroke power have been calculated by the blocks 128 and 130, a block 150 checks to determine whether the value of HWC is less than or equal to a maximum half-wave cycle value MAXHWC stored by the microprocessor 68. If this is true, control passes to a block 152, FIG. 7, which checks to determine whether the current value stored in the stroke end counter SEC is greater than or equal to 4. If this is not true, control passes back to the block 100 of FIG. 5 upon receipt of the next interrupt. On the other hand, if SEC is greater than or equal to 4, control passes to a block 154 which checks to determine whether the current calculated total stroke power TSP is less than or equal to the maximum average power calculated by the block 114 of FIG. 5. If this is also true, a flag is set by a block 156 indicating that the current stroke has been completed successfully. A block 158 then removes power from the coil 28 so that the armature 30 can be returned under the influence of the return springs 34 to the retracted position in abutment with either or both of a stroke bracket 36 and the stroke adjustment apparatus described below.

If the block 154 determines that the total stroke power exceeds the value of the maximum average power calculated by the block 114, a flag is set by a block 160 indicating that the current stroke has been completed unsuccessfully and a block 162 increments the stroke fail counter by 1. Thereafter, a block 164 checks to determine whether the stroke fail counter SFC has a current value greater than 5. If this is true, a flag is set indicating that the current stroke has been placed in the suspended mode by a block 166 and a block 168 starts a timer which is operable to maintain the suspended mode flag for a certain period of time, such as 30 seconds. Control then returns at receipt of the next interrupt to the block 100, FIG. 5, following which a block 170 checks to determine whether the 30 second timer has expired. Once this occurs, a block 172 clears or resets the suspended mode flag.

Following the block 172, or following the block 170 if the 30 second timer has not expired, control returns to the block 100 upon receipt of the next interrupt.

If the block 164 determines that the current value of the stroke fail counter SFC is not greater than 5, control passes at receipt of the next interrupt to the block 100 of FIG. 5.

As should be evident, the effect of the foregoing programming is initially to apply three half-wave rectified pulses phase controlled in accordance with the value of VCOMP and SLA to the coil 28 and thereafter apply half-wave rectified pulses which have been phase controlled in accordance with the equation implemented by the block 142 of FIG. 6. In general, the pulse widths are decreased during this interval until a stroke length of 90% is reached and thereafter the holding power is applied to the coil 28. As pulses are applied to the coil 28, the power applied to the coil during the stroke is accumulated and, if the power level exceeds the maximum average power level, a conclusion is made that the stroke has been completed unsuccessfully. If five or more strokes are unsuccessfully completed, further operation of the pump 20 is suspended for 30 seconds.

Referring again to FIGS. 11–15, a stroke length adjustment apparatus 200 according to the present invention includes a lever 202 having a manually adjustable first portion 204 and a second portion 206 disposed transverse to, and preferably perpendicular to the first portion 204. The first portion 204 of the lever 202 may have a plurality of locking teeth 205 for the purpose described hereinafter.

The apparatus 200 further includes a cam 208 having a stop surface 210 carried by the second portion 206 of the lever 202. The cam 208 includes a cylindrical mounting portion 209 having a bore 211 therethrough. A threaded end 207 of the second portion 206 of the lever 202 is inserted through the bore 211 and an aperture 213 in the stroke bracket 36 until a shoulder 216 of the lever 202 contacts a first surface 218 of the cam 208 and a second surface 219 of the cam 208 contacts a wall 220 surrounding the aperture 213 of the bracket 36. A cap nut 212 is then threaded on the end 207 of the second portion 206 to capture the cam 208 on the lever 202 and to capture the lever 202 on the bracket 36. Specifically, the cap nut 212 prevents the second portion 206 from being withdrawn upwardly (as seen in FIG. 14) owing to the interference of the outer periphery of the cap nut 212 with the bracket 36 while downward movement of the second portion 206 (as seen in FIG. 14) is prevented by the interference of the cam 208 with the bracket 36.

Figure 15:
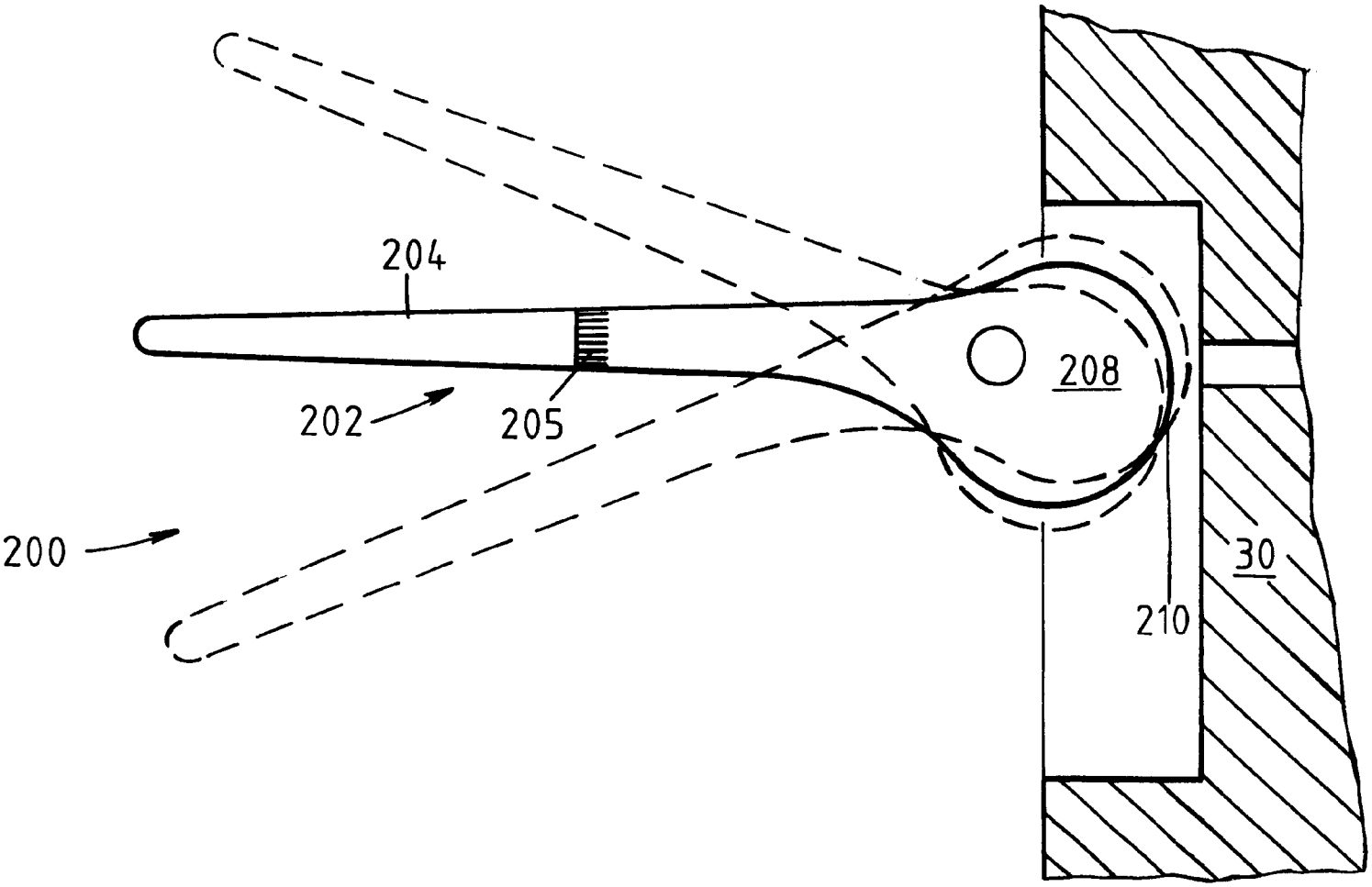
FIG. 15 is an enlarged, fragmentary, side elevational view of the stroke adjustment apparatus.

As seen in FIG. 15, the stop surface 210 has an eccentric (or other) shape such that manual movement of the lever changes the position of the stop surface 210 relative to the armature 30. This adjustment, in turn, causes the stroke length of the armature 30 to change. For example, if the user moves the first portion 204 of the lever 202 in a first direction (e.g., downwardly as seen in FIG. 15), the stroke length is decreased, and if the user moves the first portion 204 of the lever 202 in the opposite direction (i.e., upwardly as seen in FIG. 15), the stroke length is increased.

Figure 14:
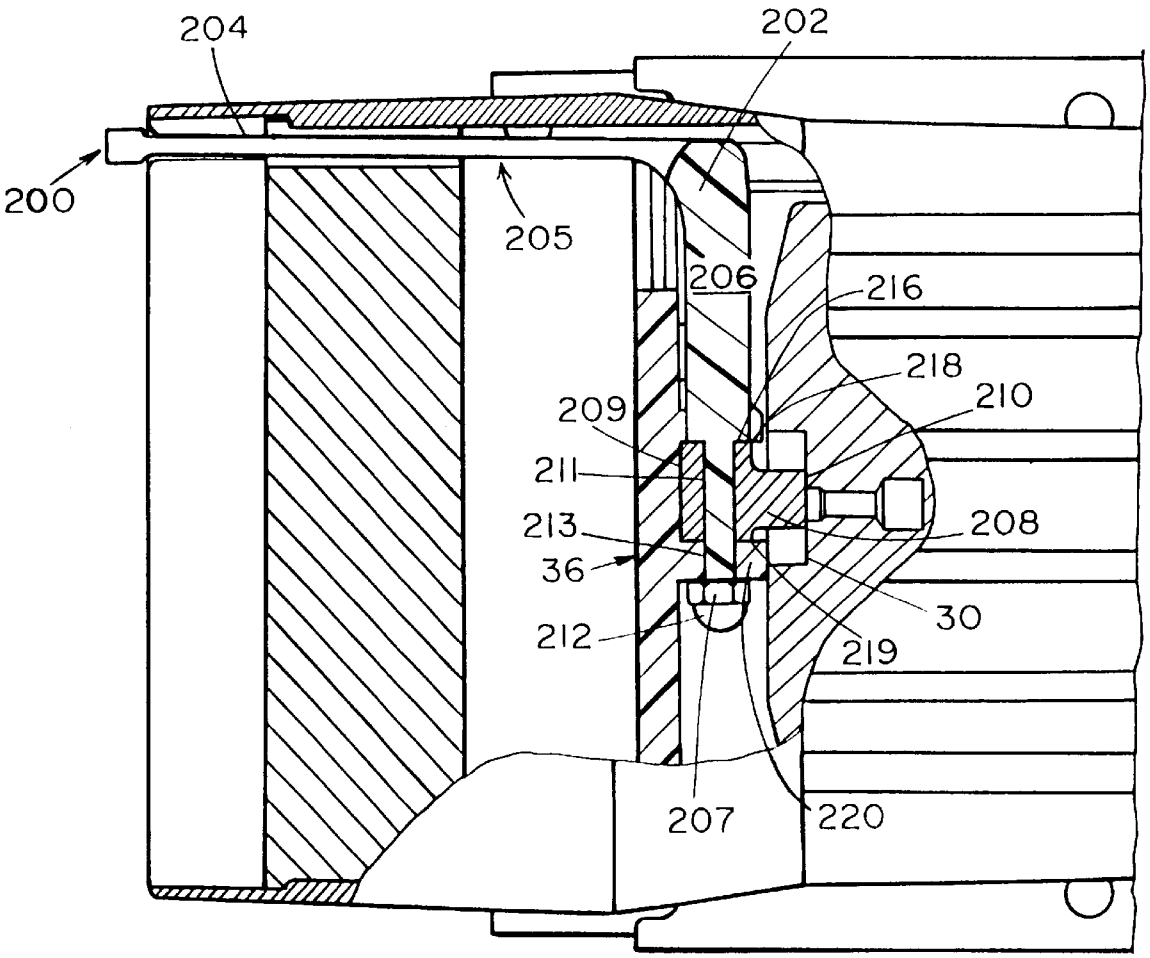
FIG. 14 is an enlarged fragmentary view partly in section of the adjustment apparatus taken generally along the lines 14—14 of FIG. 11.

In the embodiment shown in FIGS. 14 and 15, at least the first portion 204 of the lever 202 is preferably fabricated of a deformable plastic and includes at least one and preferably a plurality of locking teeth 205. The teeth 205 may be disposed on the first portion 204 opposite a plurality of teeth 230 disposed on a wall 37 as well as around the first portion 204 as shown in FIGS. 12 and 13. When no external force is exerted against the first portion 204 (e.g., by an operator of the pump) the teeth 205 firmly engage the teeth 230.

Figure 11:
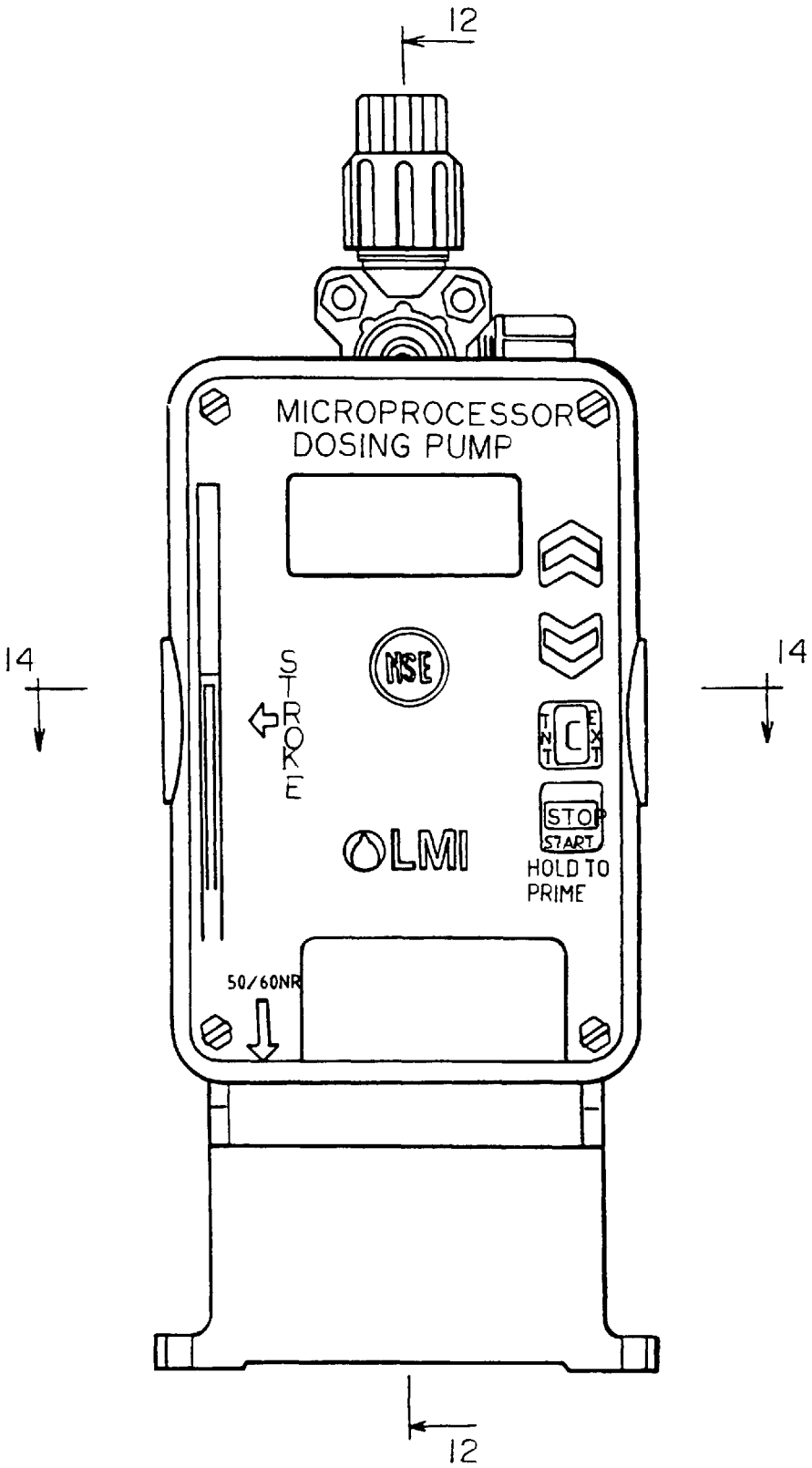
FIG. 11 is an end elevational view of an electromagnetic metering pump incorporating the present invention.

To move the lever 202, the locking teeth 205 of 5 the lever must first be disengaged from the teeth 230 on the wall 37. To do so, the first portion 204 of the lever 202 is deformed in a first direction away from the teeth 230 and transverse to the upward and downward directions as seen in FIGS. 11–13. As the lever 202 is moved in this first direction, the teeth 205 and 230 disengage or unlock, thereby allowing the lever 202 to be adjusted. Once a desired stroke length has been selected (i.e., once the lever has been moved in the upward or downward direction), the operator may release and allow the first portion 204 to return to the original position thereof such that the teeth 205 of the lever 202 re-engage the teeth 230 of the wall 37, thereby locking the lever 202 at the selected stroke length.

If desired, the lever 202 may instead be spring-loaded to cause the first portion to be normally spring-biased into engagement with the teeth 230, and to permit limited movement of the lever 202 so that adjustment of the stroke length may be effected.

In order to calibrate the pump, the cap nut 212 is first loosened to permit the cam 208 to be rotated. The armature 30 is then moved to the fully extended position (i.e., to the right-most position as seen in FIG. 13) and the lever 202 is moved to the fully downward position (see FIG. 15). The cam 208 is then rotated until it contacts the armature 30 and the cap nut 212 is tightened to maintain the cam 208 in such position.

Figure 1:
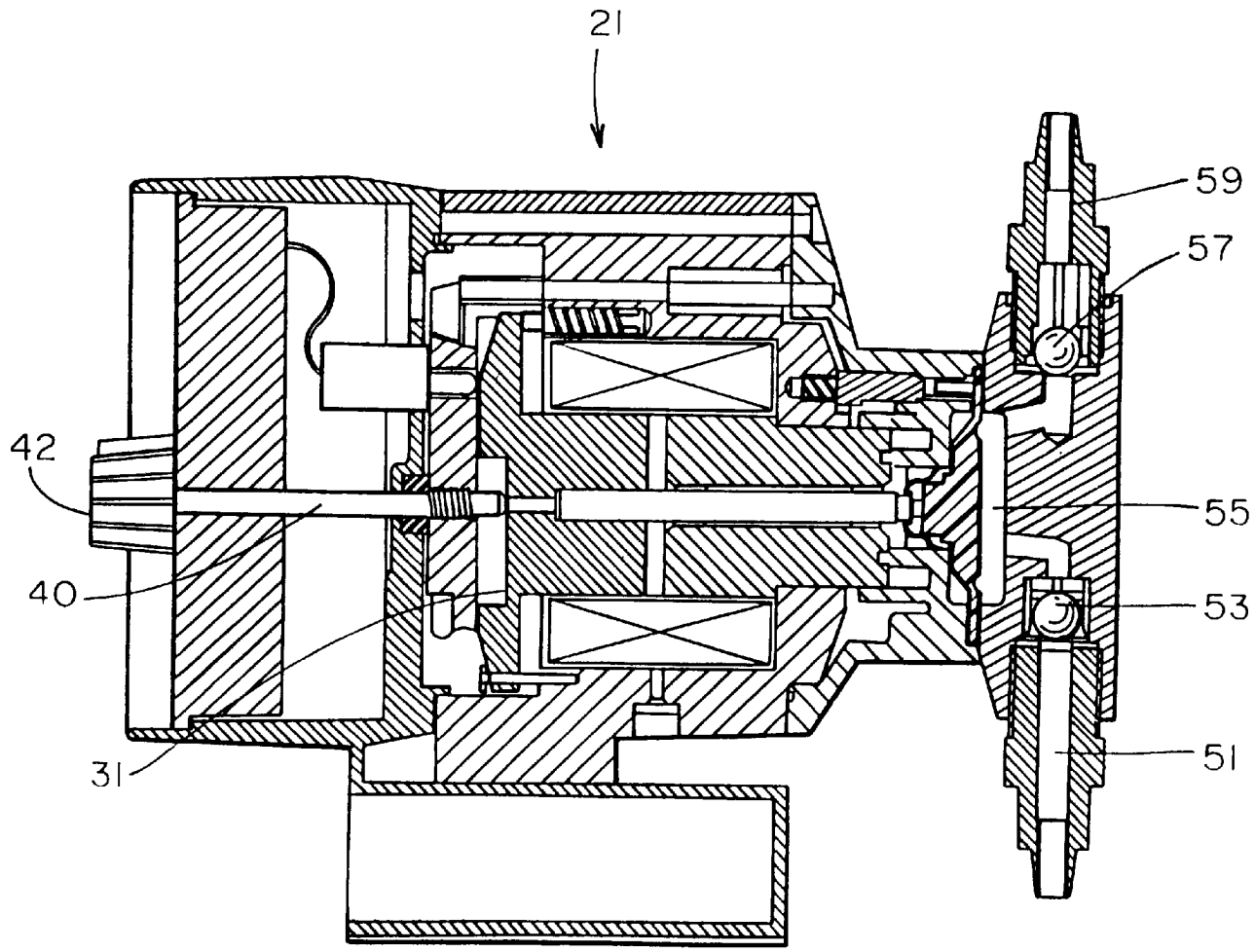
FIG. 1 is an elevational view partially in section, of an electromagnetic metering pump utilizing a prior art stroke adjustment apparatus.

The mechanical advantage afforded by the lever 202 and the cam 208 reduces the mechanical force required to change the stroke length. Hence, the lever 202 may be operated at any time, as opposed to the knob 42 and screw 40 combination of FIG. 1, which, when the pump is not operating, may be operated only when the armature 30 is spaced from the screw 40. Thus, a user may more easily adjust the stroke length.

The present invention is not limited to use with an electromagnetic metering pump. The stroke length adjustment apparatus could instead be used to control the stroke length of any other suitable device, as desired. In addition, the cam 208 may be integral with the lever 202 and the lever 202 may be mounted to the pump using any other suitable apparatus.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

What is claimed is:

1. A metering pump, comprising:

a pump element having a stroke length movable within a range of positions;

a circuit for modulating electrical power to a power unit in dependence upon the position of the pump element; and an apparatus for adjusting the stroke length of the pump element including a lever;

wherein the apparatus for adjusting the stroke length of the pump element contacts the pump element at a position within a range of positions to determine the stroke length of the pump element.

2. The metering pump of claim 1, wherein the pump element includes an armature.

3. The metering pump of claim 1, further comprising a sensor for detecting the position of the pump element.

4. The metering pump of claim 3, further comprising a processor responsive to the sensor for applying electrical power to the pump in dependence upon the position of the pump element.

5. The metering pump of claim 1, wherein the lever includes a first portion which is manually operable and a second portion.

6. The metering pump of claim 5, wherein the apparatus for controlling the stroke length of the pump element includes a cam having a stop surface that is coupled to the second portion of the lever, wherein the stop surface of the cam contacts the pump element to determine the stroke length of the pump element.

7. The metering pump of claim 6, wherein the cam is coupled to the second portion of the lever via a cap nut.

8. The metering pump of claim 5, wherein the first portion of the lever includes a locking surface.

9. The metering pump of claim 1, wherein the lever is coupled to a bracket.

10. The metering pump of claim 9, wherein the lever is coupled to the bracket via a cap nut.

11. The metering pump of claim 1, wherein movement of the lever in a first direction decreases the stroke length and movement of the lever in a second direction increases the stroke length.

12. The metering pump of claim 1, wherein the pump comprises an electromagnetic metering pump.

13. A metering pump having a power unit and a movable armature having a stroke length, comprising:

a sensor for detecting armature position;

a driver circuit coupled to the power unit and delivering electrical power to the power unit;

a programmed processor responsive to the sensor for controlling the driver circuit such that electrical power is delivered to the power unit in dependence upon the position of the armature; and an apparatus for adjusting the stroke length of the armature including, a lever having a first portion which is manually operable and a second portion;

a cam coupled to the second portion of the lever including a stop surface having a position which is variable as a function of the position of the first portion of the lever, wherein the position of the stop surface determines the stroke length.

14. The metering pump of claim 13, wherein the second portion of the lever is secured to the cam via a cap nut.

15. The metering pump of claim 13, wherein the second portion of the lever is secured to a bracket via a cap nut.

16. The metering pump of claim 13, wherein the first portion of the lever includes a locking surface.

17. The metering pump of claim 13, wherein movement of the lever in a first direction decreases the stroke length and movement of the lever in a second direction increases the stroke length.

* * * * *